United States Patent [19]

Roth

[11] 3,958,689

[45] May 25, 1976

[54] MATCHBOOK

[76] Inventor: Edwin H. Roth, 321 Rear Adelia St., Middletown, Pa. 17057

[22] Filed: Apr. 1, 1975

[21] Appl. No.: 564,091

[52] U.S. Cl. ..... 206/104; 206/106; 206/114; 206/457

[51] Int. Cl.[2] ..... A24F 27/00

[58] Field of Search ..... 44/48; 206/90, 98–100, 206/103–104, 106, 108–109, 112, 114, 137, 457, 459

[56] References Cited

UNITED STATES PATENTS

| | | | |
|---|---|---|---|
| 969,045 | 8/1910 | Von Deylen | 206/96 |
| 2,077,023 | 4/1937 | Spira | 206/109 |
| 2,116,231 | 5/1938 | Beyer | 206/106 |
| 2,121,136 | 6/1938 | Wallace | 206/114 |
| 3,891,083 | 6/1975 | Roth | 206/98 |

*Primary Examiner*—Steven E. Lipman
*Attorney, Agent, or Firm*—O'Brien & Marks

[57] ABSTRACT

The cover of a matchbook has a perforated tear line or the like arranged relative to a striking strip or igniting material on the cover and relative to a staple, glue, or other means securing the cover on a match comb, such that a portion of the cover containing at least a portion of the striking strip can be readily removed to impede further ignition of matches on the striking material.

16 Claims, 20 Drawing Figures

FIG. 1
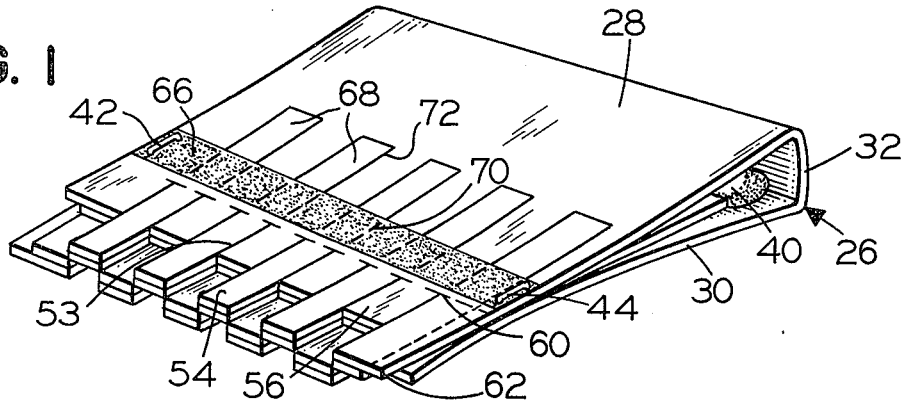
FIG. 2
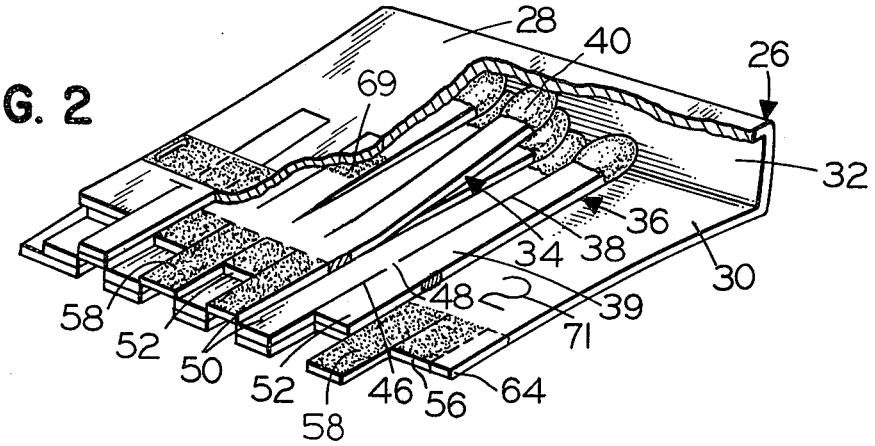
FIG. 3
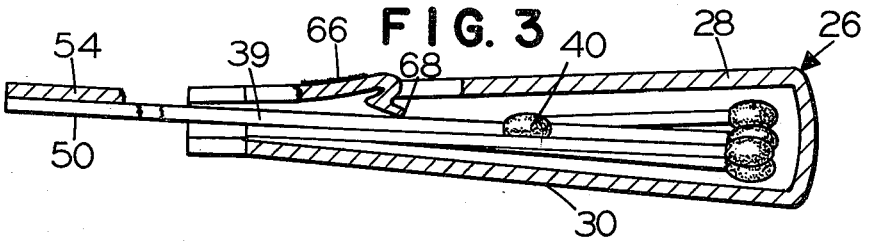
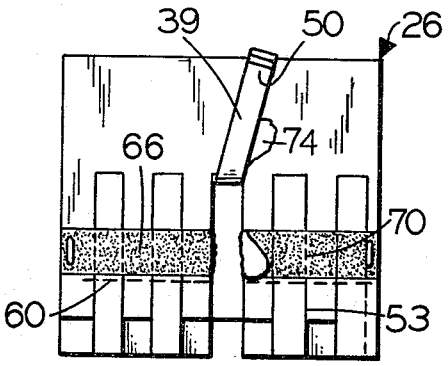
FIG. 4
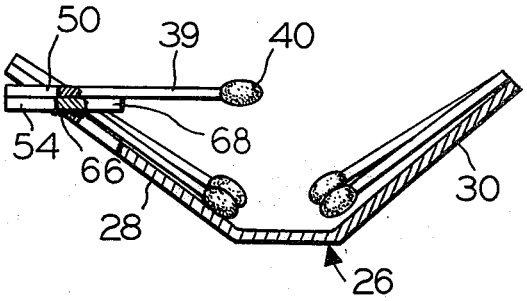
FIG. 5

FIG. 6
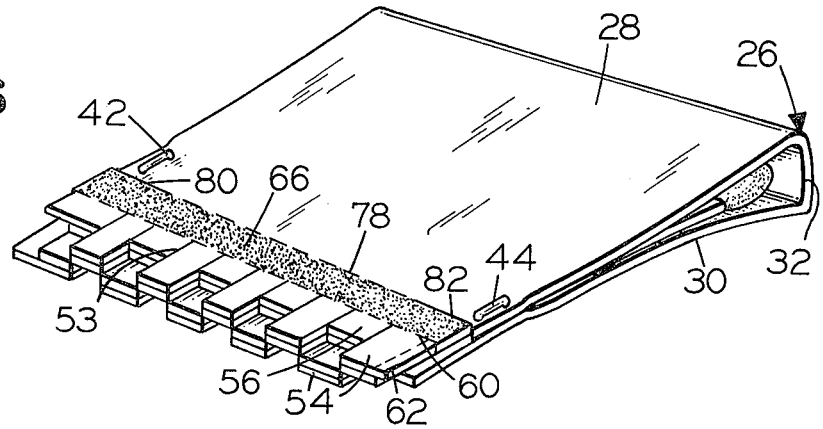
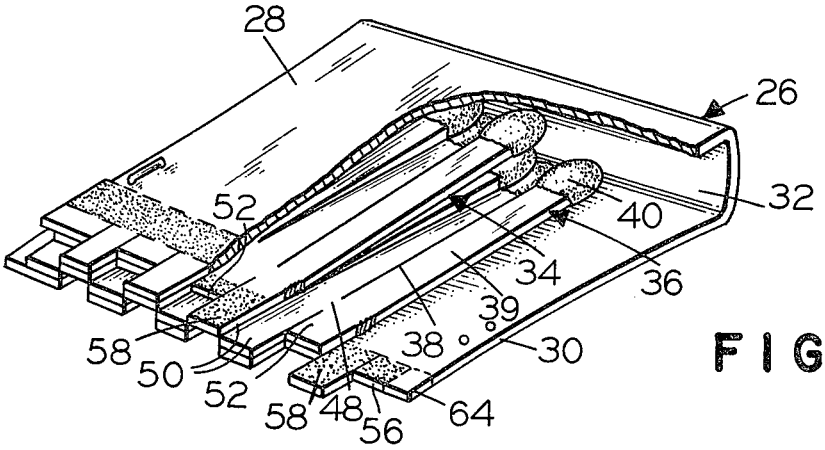
FIG. 7
FIG. 8
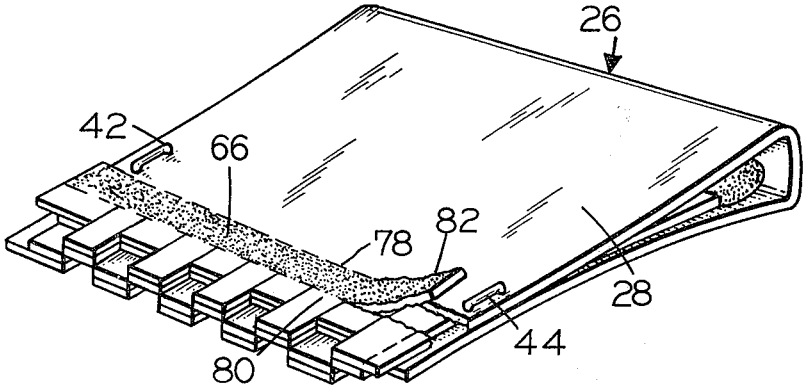
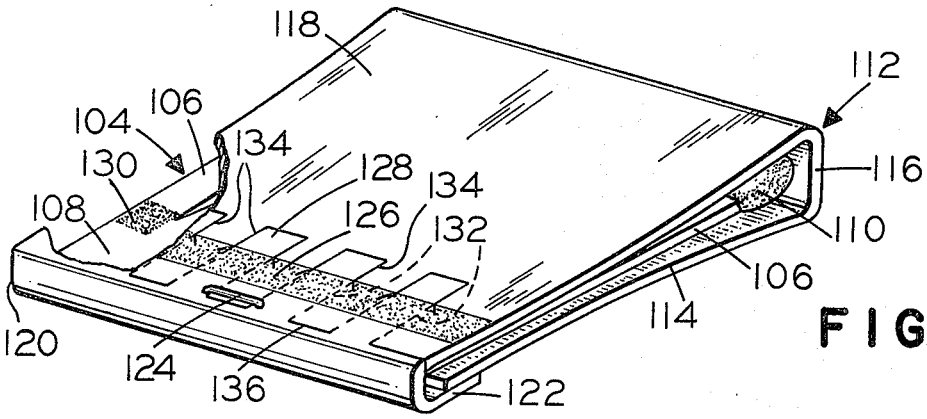
FIG. 9

FIG. 14
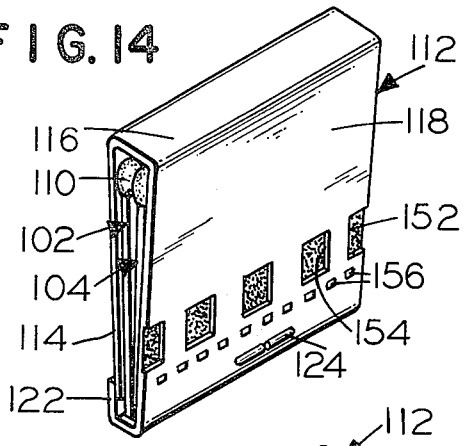
FIG. 15
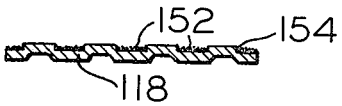
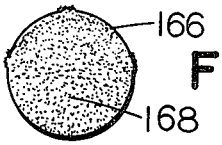
FIG. 18
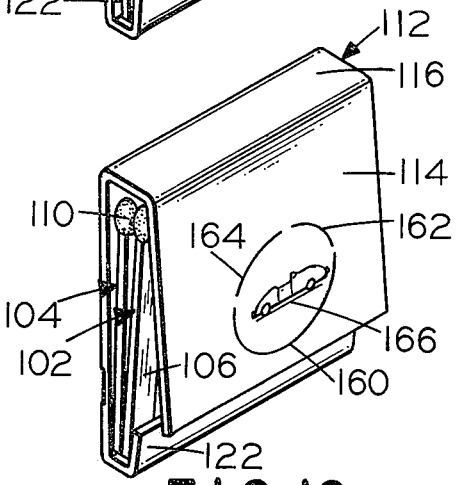
FIG. 16
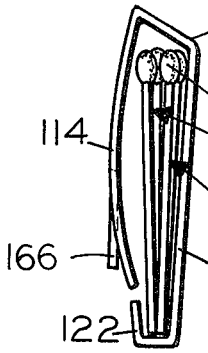
FIG. 17
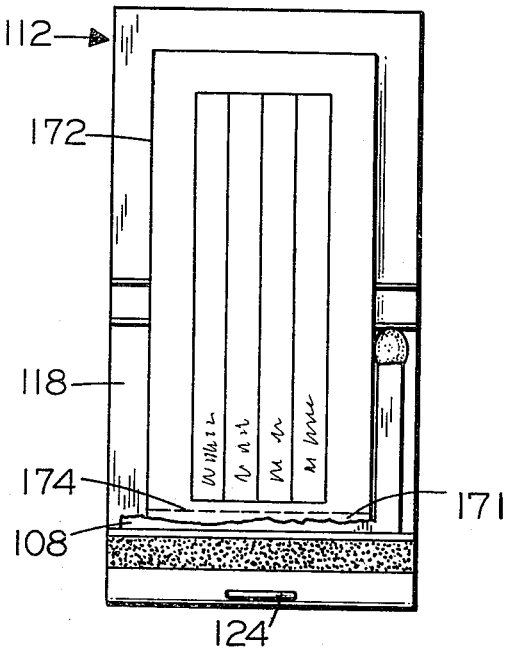
FIG. 19
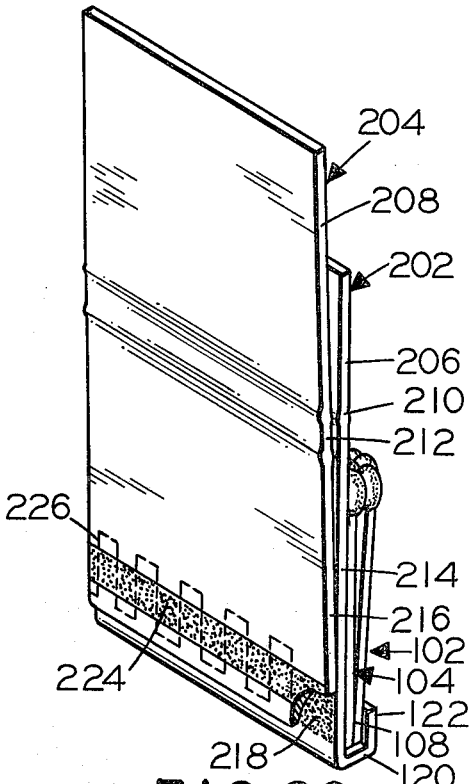
FIG. 20

MATCHBOOK

BACKGROUND OF THE INVENTION

1. Field of the Invention

The invention relates to packages of safety type matches, and in particular, to paper matchbooks having a striking strip on the cover for igniting matches in the matchbook.

2. Description of the Prior Art

The prior art, as exemplified in U.S. Pat. Nos. 831,021, 1,912,957, 2,002,051, 2,018,970, 2,039,491, 2,118,634, 2,279,893, 2,284,032, 2,303,287, 2.405,865, 2,532,440, 2,623,866, 2,771,183, 2,935,184 and 3,358,817, contains a variety of safety matches including paper matchbooks with striking strips on the cover for igniting matches. Conventional paper matchbooks which are relatively inexpensive and easy to use are often objects of attraction and play for children who are capable of igniting the matches in the matchbooks but who do not understand the danger or the proper handling of ignited matches; making matchbooks more inexpensively and easy to ignite have previously been dominant goals of the matchmaking industry while the safety of matchbooks around children has been of secondary consideration.

Matchbook covers have been used for order forms and have been extended in length to permit folded under portions with more advertising or the like. Also, separate inserts have been used for order forms. When a cover is used for an order form, there is usually a printed line, which may be dashed, on the back of the cover with a printed phrase such as "DETACH HERE, DO NOT MAIL MATCHES"; some of such matchbooks have the striking strips located on the back of the cover on the portion of the covers containing the printed order forms which are to be detached by cutting along the printed lines. However, portions of the cover with order forms are often torn from matchbooks such that sometimes the folded ends of the staples securing the covers on the match combs are caused to bend out from the covers; thus leaving sharp, exposed points of the staples which are dangerous.

SUMMARY OF THE INVENTION

The invention is summarized in that a matchbook includes a paperboard comb having a plurality of matches each having an ignition head at one end, a paperboard cover folded over the ignition heads of the comb, means securing the cover to the comb, an igniting material on the cover, the cover having a perforation such that a portion of the cover is readily removable, and the readily removable cover portion containing at least a portion of the igniting material to impede ignition of matches on the igniting material when the readily removable cover portion is removed.

An object of the invention is to construct a matchbook which, if played with by small children, would tend to be rendered incapable of ignition.

Another object of the invention is to provide a paper matchbook with an igniting material on a cover which is readily destroyed or rendered ineffective by improper use of the matchbook.

It is also an object of the invention to provide a matchbook with a cover having removable portions for orders and the like which when removed do not create a hazardous condition.

One particular advantage of the invention is that when portions of a matchbook cover are removed, either the protection of matchheads by the cover is maintained or at least portions of the striking or igniting material are removed along with the removed portion of the cover to impede improper ignition of matches by the igniting materials.

Other objects, advantages, and features of the invention will be apparent from the following description taken in conjunction with the accompanying drawings.

BRIEF DESCRIPTION OF THE DRAWINGS

FIG. 1 is a perspective view of a matchbook in accordance with the invention.

FIG. 2 is a perspective view similar to FIG. 1 but with portions of the matchbook of FIG. 1 broken away.

FIG. 3 is a side cross-sectional view of the matchbook of FIG. 1 with a match partially removed from the matchbook.

FIG. 4 is a front view of the matchbook of FIG. 1 illustrating an improper method for removing a match from the matchbook.

FIG. 5 is a side cross-sectional view of the matchbook of FIG. 1 illustrating another improper method of removing a match from the matchbook.

FIG. 6 is a perspective view of a modified matchbook in accordance with the invention.

FIG. 7 is a perspective view with parts broken away of the matchbook in FIG. 6.

FIG. 8 is a perspective view illustrating removal of a cover portion containing the igniting strip of the matchbook of FIG. 6.

FIG. 9 is a perspective view of another modified matchbook in accordance with the invention.

FIG. 14 is a perspective view of another variation of the matchbook in accordance with the invention.

FIG. 15 is a cross-sectional view of a cover portion containing the igniting strip of the matchbook of FIG. 14.

FIG. 16 is a perspective view from an angle opposite to the view of FIG. 14 and showing the front of the matchbook of FIG. 14.

FIG. 17 is a side view of the matchbook of FIG. 14 illustrating the closure of the matchbook.

FIG. 18 is a rear view of cover portion removed from the cover of the matchbook of FIG. 14.

FIG. 19 is a front view with a cover open and most of the matches removed of a further modification of the matchbook in accordance with the invention.

FIG. 20 is a perspective view of a still further modified matchbook in accordance with the invention.

DESCRIPTION OF THE PREFERRED EMBODIMENT

Figure 10:
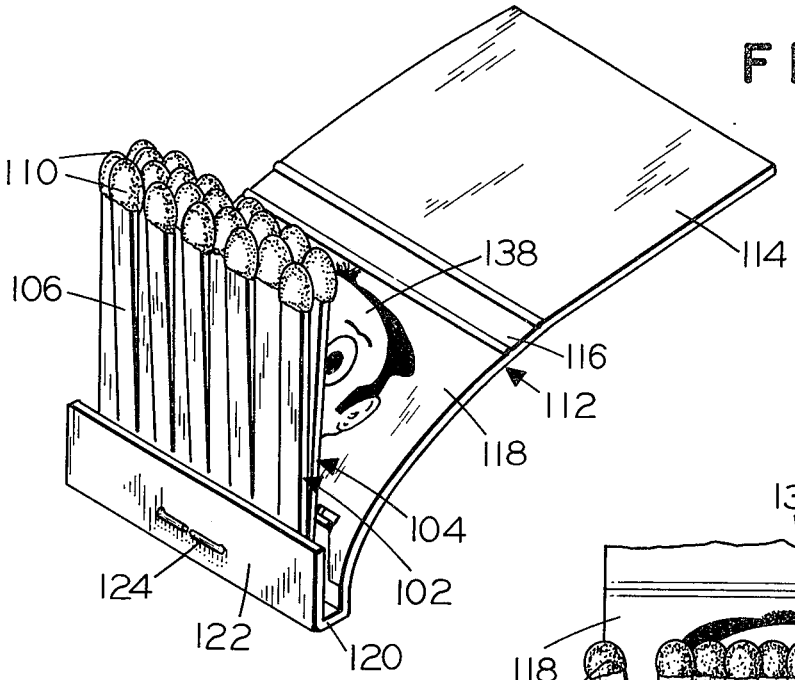
FIG. 10 is a perspective view from an angle opposite to the view of FIG. 9 of the matchbook of FIG. 9, and with the cover opened.

As illustrated in FIGS. 1 and 2, the invention is embodied in a book of matches including a cover indicated generally at 26 and having a front panel 28 and a rear panel 30 folded at score lines on the front and back of a head panel 32 over front and rear match combs respectively indicated generally at 34 and 36. The match combs 34 and 36 are formed of paperboard with cuts 38 forming strips or match splints 39 which have their ends coated with a suitable safety match material or materials to form match heads 40 of the match combs 34 and 36. The panels 28, 30 and 32 are also formed from a suitable paperboard and are folder over the match heads 40 with the front and rear panels 30 and 32 extending from the head panel 32 over the match splints while being secured by suitable means such as staples 42 and 44 at lateral edges of the match combs 34 and 36.

Cuts 46 in the bottom portion of the match combs 34 and 36, aligned with the cuts 38 and separated from cuts 38 by uncut portions 48, form alternate long pull tabs 50 and short pull tabs 52. The long pull tabs 50 of the front match comb 34 overly the short pull tabs 52 of the rear comb 36 while the short pull tabs 52 of the front match comb 34 overly the long pull tabs 50 of the rear match comb 36. The uncut portions 48 have a width designed to produce a sheer strength to longitudinal forces on the pull tabs 50 and 52 which is within the range from one-half to one times the tensile strength of each of the tabs 50 and 52.

The front and rear panels 28 and 30 have suitable cuts formed in the bottom ends thereof forming long tabs 54 and short tabs 56 corresponding to the respective long pull tabs 50 and short pull tabs 52 of the match combs 34 and 36. Glue, as indicated by the stippling 58, joins the tabs 54 and 56 of the front panel 28 and the tabs 54 and 56 of the back panel 30 to the respective pull tabs 50 and 52 of the front and rear match combs 34 and 36. Transverse perforated or score lines 60 extend across the cover at the upper end of the tabs 54 and 56 in both the front and rear panels 28 and 30 above the glue 58 so that the tabs 54 and 56 may be readily torn from the rest of the cover 26. Perforated corners 62 and 64 are formed on the right side of the right-most tabs 54 and 56 of the respective front panel 28 and rear panel 30.

An igniting material or striking strip 66 is formed by printing or depositing a suitable safety igniting material in a strip transversely or perpendicularly across the panel 28 just above the tabs 54 and 56. Tabs 68 are cut in the cover 28 to extend upward from the striking strip 66 in alignment with the tabs 54 and have their upper ends secured to alternate match splints of the match comb 34 by glue spots indicated by stippling 69. Perforated lines 70 are cut in the cover panel 28 across the striking strip 66 in alignment with the cuts 53 and the side cuts 72 of the tabs 68. The perforated lines 70 are formed such that the cover panel 28 will readily tear along the lines 70 except that they have a strength greater than the resistance of the joined surfaces of the tabs 68 and the match splints 32 to be peeled apart at the glue spots 69.

Indicating indicia such as characters 71 are printed on the rear cover 30 in alignment with the tabs 68 such that upon removal of the matches from the matchbook, the characters 71 will be visible through windows formed by pulling the tabs 68 inward into the cover 26.

In use of the matchbook of FIGS. 1 and 2, the perforated corners 62 and 64 are first removed. The joined tabs 50 and 54 immediately adjacent the corners 62 and 64 are gripped and pulled lengthwise from the matchbook tearing the tab 54 at the score line 60 as well as the uncut portion 48 of the pulled match. A slight bending or twisting of the tabs 50 and 54 may be performed prior to pulling in order to initially weaken or tear tab 54 at the score line 60. As the sheared match is pulled from between the front and back panels 28 and 30 of the cover 26, the tab 68 is drawn inwardly beneath the panel 28, FIG. 3, and the attached portion of the tab 68 is peeled from the match splint 39 to separate the tab 68 from the match splint. The strength of the glued surface portions of paperboard match splints 39 or the tabs 68 against peeling being less than the tear strength of the perforated lines 70 insures that the tabs 68 are peeled from the match splints 39 rather than continuing to tear along the perforated lines 70 when the match splints 39 are pulled longitudinally from between the panels 28 and 30.

The matches must be removed in a predetermined order beginning with the long tabs 50 and 54 immediately adjacent the perforated corner 62 and then removing the match with short tabs 52 and 56 underlying the just-removed match with long tabs. Thereafter, the next adjacent matches can be removed with the match having the long pull tab 50 being removed first. If the predetermined order is not followed, i.e., if a match not immediately adjacent the perforated corners 62 and 64 or not immediately adjacent a previously removed match is attempted to be pulled, the tab 50 or 52 tears from the respective match since the shear strength of the uncut portions 48 on both sides of the match exceeds the tensile strength of the tab 50 or 52. Small children who may happen to pick up the matchbook of FIG. 1 will not necessarily be able to follow the predetermined order of removal and hence by pulling would tend to tear off the match tabs rather than being able to remove the matches from the matchbook.

Also, as illustrated in FIG. 4, removal of the matches by pulling the tabs 50 and 54 forward instead of pulling the tab 50 longitudinally from the matchbook tears a cover portion underlying the striking strip 66 along perforations 70, thus tearing a portion of the striking strip 66 to impede its utiilization to light a match since a considerable length of the striking strip must be employed to obtain sufficient ignition friction to bring about ignition of the matches. Children not being able to comprehend the correct removal of the matches from the matchbook would tend to pull the tabs and matches transverse from the cover and thus tear the striking strip 66 tending to render the matchbook unusuable. Additionally, a portion 74 of the outer surface layer of the cover 26 may be pulled off with a corresponding portion of the striking strip 66 to further impede ignition by the strip 66.

If the front and back panels 28 and 30 are opened by removal of the staples 42 and 44 or by tearing the portions of the panels 28 and 30 joined by the staples 42 and 44, the removal of the matches by gripping the heads 40 and pulling upward as illustrated in FIG. 5 would tend to pull the tabs 68 along with the matches causing the panel 28 to be torn along the perforated lines 70 thus impeding use of the striking strip 66. Thus, proper use of the matchbook will be encouraged in order to obtain full utilization of the matches therein.

In a modified matchbook of FIG. 6, parts are identified by the same numerals used to identify parts of the matchbook in FIGS. 1–5 indicating that such similarly identified parts have substantially the same structure and/or function. In the modification of FIGS. 6 and 7, the staples 42 and 44 are placed above the striker strip 66 and a perforated line 78 is formed in the cover panel 28 immediately above the striker strip 66 but below the staples 42 and 44. The perforated line 78 terminates in cuts 80 and 82 extending to the lateral edges of the cover panel 28 immediately below the staples 42 and 44. The staples 42 and 44 pinch together portions of the panels 28 and 30 immediately above the cuts 80 and 82 thus forming upstanding corners on the ends of the cover portion containing the striker strip 66. A child can easily pull upon the upstanding corners formed by the cuts 80 and 82 and the staples 42 and 44 tending to rip the portion of the panel 28 between the perforated lines 78 and 60 including the striking strip 66 from the cover 26 as illustrated in FIG. 8. Once the striking strip 66 has been torn from the cover 28 it is difficult for an individual such as a child to utilize the striking strip 66 to ignite a match.

The modified matchbook of FIGS. 9 and 10 has a front match comb 102 and a rear match comb 104 formed of paperboard material with cuts forming match splints 106 extending from an uncut base portion 108. The free ends of the splints 106 are coated in a conventional fashion to form the match heads 110. A paperboard cover, indicated generally at 112, for the match combs 102 and 104 has a front panel 114 which is hinged to a head panel 116 which in turn is hinged to the top of a rear panel 118. The rear panel 118 is suitably joined by a bottom portion 120 to a front flap 122. The front flap 122, the bottom portion 120 and the bottom of the rear panel 118 are folded over the uncut base portions 108 of the match combs 102 and 104. Suitable means, such as a staple 124, secures the front flap 122 and the bottom portion of the rear panel 118 to the uncut base portions 108 of the match combs 102 and 104 as well as securing the uncut base portions 108 together. The length of the front panel 114 is selected such that the free end of the front panel 114 may be inserted between the flap 122 and the front match comb 102 to enclose the match combs 102 and 104. A striking strip 126, of suitable safety striking material, is formed across the bottom portion of the rear panel 118. Tabs 128 are cut into the back panel 118 immediately above the striking strip 126 and may be attached to the bottom portion 108 and/or lower portions of the match splints 106 of the rear match comb 104 by suitable means such as glue spots 130. Perforated lines 132 are formed in the back panel 118 from side cuts 134 of the tabs 128 across the striker strip 126 to cuts 136 connecting to side perforated lines extending from adjacent tabs 134. Thus the tabs 134, perforated lines 132 and cuts 136 form a readily tearable zigzag pattern across the striking strip 126 and the bottom portion of the rear panel 118. In addition, the inside surface of the rear panel 118 may include an attractive pattern or picture such as a caricature 138 which may extend down to the bottom portion of the rear panel 118.

Figure 11:
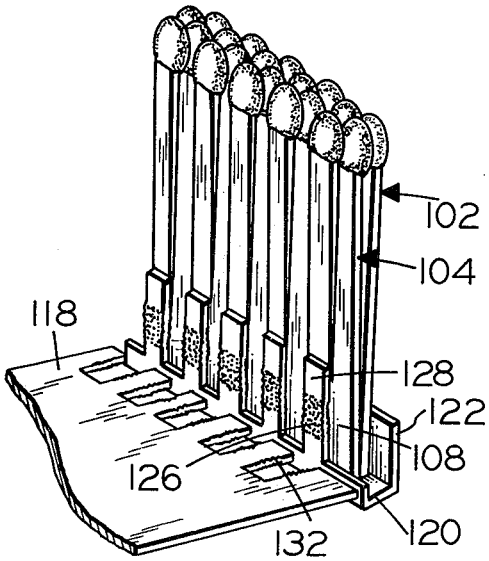
FIG. 11 is a perspective view of the matchbook of FIG. 9 from still another angle and illustrating removal of a cover portion of the matchbook.

As shown in FIGS. 10 and 11, the cover 112 is opened by folding the front panel 114 upward to expose the match combs 102 and 104. Bending the cover and rear panel 118 backward puts stress on the bottom portion of the rear panel 118 where joined by the dashed, perforated lines 132. A child, attracted by the caricature 138, may tend to bend the rear panel 118 backward to better view the caricature 138 with sufficient force to tear the perforated lines 132 and thus remove the front panel 114, the head panel 116 and most of the rear panel 118 from the rest of the cover 112; thus, alternate sections of the striking strip 126 between the perforated lines 132 are ripped from the rest of the matchbook to impede or substantially prevent utilization of the striking strip 66 to ignite matches.

Figure 12:
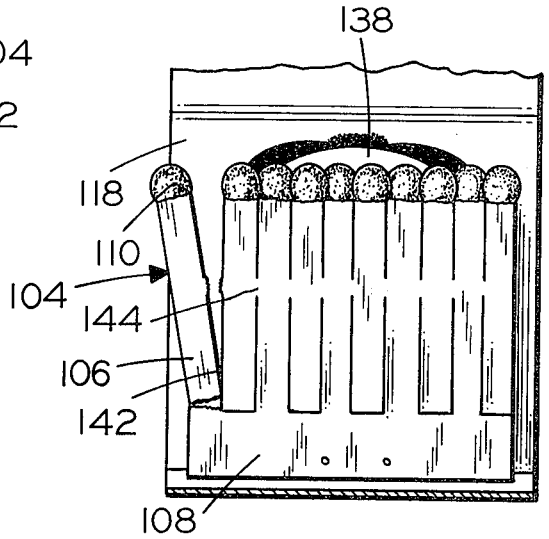
FIG. 12 is a front view with portions broken away of the matchbook in FIG. 9.

The matchbook, as illustrated in FIG. 12, may include uncut portions 144 joining the match splints 106 of the match comb 104 midway in the cuts 142 forming the match splints 106. This tends to render the match comb 104 stiff so that when one or more of the matches 106 of the match comb 104 are pulled forward to better view the caricature 138 on the inside of the rear panel 118, the match comb 106 as a whole is pulled forward tending to pull the match cover 112 from the matchbook by the zigzag pattern of cuts and perforations across the striker. The match splints 106 of the match comb 104 may be readily separated by a sideways pull.

Figure 13:
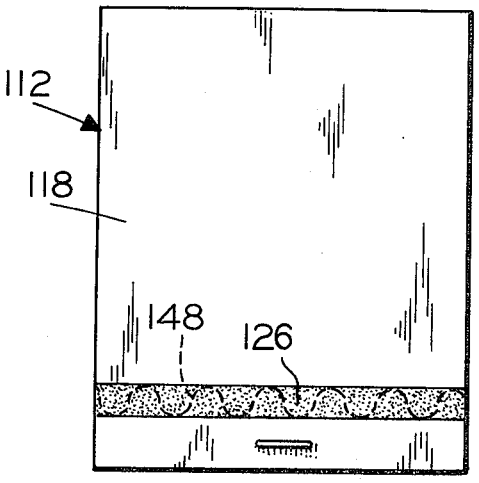
FIG. 13 is a back view of still another modified matchbook in accordance with the invention.

In the variations of FIG. 13, the back 118 of the cover 112 has a zigzag perforated line which is a serpentine perforated line 148 extending through the striking strip 126 such that the upper portion of the back panel 118 can be readily separated from the lower portion of the panel 118. The serpentine perforation 126 is designed to divide the strip 126 into small segments rendering the striking strip difficult to use to light a match thereon.

The matchbook of FIGS. 14, 15, 16, 17 and 18 has parts identified by numerals used to identify parts of the matchbook of FIGS. 9–12 indicating that such commonly identified parts have substantially similar structure and/or function. The modified matchbook, as shown in FIGS. 14 and 15, has a striking strip on the back panel 118 which is formed by depositing a row of segments 152 of igniting material within spaced indentations 154 formed in the back panel 118. The length of the segments 152 together with the igniting material is selected to prevent ignition of a match head 110 by friction across only one segment; rather, the user must strike the match completely across two or three of the striking segments 152 in order to ignite the match head 110. The indentation 154 is selected to slightly recess the striking segments 152 so that the leading edges of the striking segments 152 do not engage the match head 110 when the match head is rubbed along the striking strip. Often the edge of the segments 152, if protruding, would have sufficient frictional engagement with the match heads 110 to ignite the matches; thus the recesses 154 ensure that the match heads 110 must cross two or three segments in order to ignite the matches. In addition, the back panel 118 has a perforated line 156 which extends across the bottom of the rear panel 118 between the row of striking segments 152 and the staple 124 such that the upper portion of the rear panel 118, the head panel 116, and the front panel 114, can be readily removed by tearing the cover 112 along the perforated line 156 to render it more difficult for small children to ignite a match on the striking strip. Further, the perforation enables the portion of the cover 112 containing the striking strip to be easily removed without opening the staple 124.

As illustrated in FIGS. 16, 17 and 18, the front cover 114 has cuts 160, 162 and 164 forming a removable portion 166 which would not expose the match heads 110 if removed and the cover 112 is properly closed. As shown in FIGS. 18, the removable portion 166 has glue, as shown by the stippling 168, on the back surface thereof so that the removable portion 166 may be utilized as a label or marker when ordering goods or the like from an advertisement on the cover 112. The shape of the removable portion 166 may be rectangular, diamond-shaped, or any other shape which the manufacturer or advertiser may desire. In one preferred embodiment, as illustrated in FIGS. 16, 17 and 18, the removable portion 166 is round, with the cut 160 extending around a major portion of the bottom of the removale portion tangential to a line parallel the bottom end of the front panel 114 such that when the cover panel 114 is bent to reinsert its free end behind the flap 122, as shown in FIG. 17, the bottom edge of the removable portion 166 along the cut 160 protrudes such as to be engaged by a finger of the person using the matchbook; this engagement with the bottom edge of the removable portion 166 along the cut 160 will draw the attention of the user and further increase the advertising effectiveness of the matchbook.

In the modification of FIG. 19, a base 171 of an insert or additional cover 172 is stapled within the cover 112 between the rear panel 118 and lower portion 108 of the rear match comb. The insert 172 has a perforated line 174 extending thereacross above the staple 124 to allow easy removal thereof. The insert 172 may have suitable markings thereon for being filled in to order goods or the like advertised on the matchbook.

The matchbook of FIG. 20 has an inner cover 202 and an outer cover 204 having respective front panels 206 and 208, head panels 210 and 212, and respective back panels 214 and 216. The inside cover 202 has a bottom connecting portion 120 joined to a front flap 122 which together with the back panel 214 of the cover 202 are secured to the bottom portion 108 of the match combs 102 and 104. The bottom portion of the rear panel 216 of the outer cover 204 is secured to the bottom portion of the rear panel 214 of the inner cover 202 by glue 218. A striking strip 224 is formed across the bottom portion of the rear panel 216 and the outer cover 204 in a conventional manner. A zigzag perforated line 226 meanders back and forth across the striking strip 224 throughout its length such that, when the outer cover 204 is pulled from the inner cover 202, portions of the back panel 216 containing portions of the striking strip 224 will be torn from other portions of the back panel 216 containing other portions of the striking strip 224; thus, the striking strip 224 will be divided or torn into small segments rendering it difficult for the user to ignite a match on striking strip 224. The inside cover 202 will have the appearance of a toy to a child and the natural tendency of a child will be to pull the covers 202 and 204 apart which will efffectively destroy the striking strip 224 preventing the child from later on igniting a match thereon.

Since many modifications, variations, and changes in detail may be made to the presently described embodiments, it is intended that all matter in the foregoing description and in the accompanying drawings be interpreted as illustrative and not in a limiting sense.

What is claimed is:

1. A matchbook comprising a paperboard comb having a plurality of matches each having an ignition head at one end, a paperboard cover folded over the ignition heads of the comb, means securing the cover to the comb, an igniting material on the cover, said cover having a perforation such that a portion of the cover is readily removable, and said readily removable cover portion containing at least a portion of the igniting material to impede ignition of matches on the igniting material when the readily removable cover portion is removed.

2. A matchbook as claimed in claim 1 wherein at least a portion of the perforation in the cover extends between the igniting material and the means securing the cover to the comb such that the cover can be readily separated at the perforation.

3. A matchbook as claimed in claim 1 wherein the perforation is a zigzag perforated line extending back and forth across the igniting material.

4. A matchbook as claimed in claim 1 wherein the perforation in the cover includes a perforated line extending completely across the cover between the igniting material and the means securing the cover to the comb.

5. A matchbook as claimed in claim 4 wherein the cover includes two perforated lines extending on opposite sides of the igniting material.

6. A matchbook as claimed in claim 4 wherein the perforated line terminates in a cut adjacent an edge of the cover and the means securing the cover bends the cover adjacent the cut such as to form an upstanding corner.

7. A matchbook as claimed in claim 1 wherein portions of the cover are glued to the match combs.

8. A matchbook as claimed in claim 1 wherein the perforation in the cover includes a perforated zigzag line extending back and forth across the igniting material and portions of the cover beneath the igniting material are glued to the match comb such that portions of the cover to be separated along the perforations contain portions of the igniting material.

9. A matchbook as claimed in claim 8 wherein the matches are joined at an intermediate tear point.

10. A matchbook as claimed in claim 1 wherein the securing means includes a staple securing the cover to the match comb.

11. A matchbook as claimed in claim 1 wherein the cover includes a caricature to entice children to tear the removable cover portion from the matchbook to thus impede the ignition of matches on the igniting material.

12. A matchbook as claimed in claim 1 wherein there is included inside and outside covers, and wherein the igniting material is on the outside cover and the outside cover has the perforation.

13. A matchbook as claimed in claim 1 wherein the igniting material is deposited in spaced segments in a row across the cover.

14. A matchbook as claimed in claim 13 wherein the cover has indentations and the igniting material is deposited within the indentations.

15. A matchbook comprising a paperboard comb having a plurality of matches each match having an ignition head at one end and a pull tab formed at the other end, said plurality of matches being joined by tear portions adjacent the pull tabs, a paperboard cover folded over the ignition heads of the comb and secured together on opposite lateral edges of the paperboard comb, an igniting strip on the folded cover transverse to the plurality of matches and adjacent the other ends of the plurality of the matches, said cover having a plurality of slots cut therein to form tabs extending longitudinally along portions of selected matches of the plurality of matches with portions of the cover tabs glued to the selected matches, said plurality of slots extending to points adjacent the igniting strip such that removal of one of the selected matches by forces transverse to the paperboard cover tend to tear the cover across the igniting strip.

16. A matchbook as claimed in claim 15 wherein said cover tabs are formed in the cover intermediate to the one and other ends of the plurality of matches, and said cover tabs are capable of being folded internally into the cover as selected matches are withdrawn lengthwise from the cover to form windows in the cover, and there is included indicating means within the cover to be exposed through the windows formed by the folded in cover tabs.

* * * * *